United States Patent [19]

Phillips et al.

[11] Patent Number: 4,717,908

[45] Date of Patent: Jan. 5, 1988

[54] CREDIT CARD CASE WITH ALARM SYSTEM

[75] Inventors: Bradford E. Phillips; Roy J. Bertacchi; John E. Busse, all of Cincinnati, Ohio

[73] Assignee: 'totes', Incorporated, Loveland, Ohio

[21] Appl. No.: 930,401

[22] Filed: Nov. 21, 1986

[51] Int. Cl.[4] ..... G08B 13/14

[52] U.S. Cl. ..... 340/568; 116/84; 150/133; 150/134; 150/147; 340/571

[58] Field of Search ..... 340/568, 571; 116/84; 150/133, 134, 147, 148, 149

[56] References Cited

U.S. PATENT DOCUMENTS

| | | | |
|---|---|---|---|
| 350,450 | 10/1886 | Tucker | 340/568 |
| 463,001 | 11/1891 | Smith | 340/568 |
| 1,685,329 | 9/1928 | Lynch | 340/568 |
| 2,461,588 | 2/1949 | Cooper | 150/102 |
| 3,120,041 | 2/1964 | Voss | 150/137 |
| 3,369,585 | 2/1968 | Martinsen | 150/147 |
| 3,444,914 | 5/1969 | French | 150/147 |
| 3,602,562 | 8/1971 | Radelfinger | 312/119 |
| 3,648,832 | 3/1972 | Kersenbaum et al. | 206/0.83 |
| 3,855,588 | 12/1974 | Buckland Jr. et al. | 340/309.4 |
| 3,893,096 | 7/1975 | Tucci et al. | 340/568 |
| 3,958,527 | 5/1976 | Iannacore | 340/613 |
| 3,959,789 | 5/1976 | McGahee | 340/568 |
| 4,042,918 | 8/1977 | Llitzman | 340/568 |
| 4,043,321 | 4/1978 | LeBron et al. | 116/84 |
| 4,118,692 | 10/1978 | Fitchett | 340/568 |
| 4,162,695 | 7/1979 | Moses | 150/102 |
| 4,183,019 | 1/1980 | Lekhtman | 340/568 |
| 4,253,084 | 2/1981 | Topputo | 340/568 |
| 4,317,112 | 2/1982 | Beier et al. | 340/568 |
| 4,399,431 | 8/1983 | Satomi et al. | 340/568 |
| 4,480,250 | 10/1984 | McNeely | 340/568 |
| 4,484,183 | 11/1984 | Money | 340/568 |
| 4,489,314 | 12/1984 | Miller | 340/568 |
| 4,531,116 | 7/1985 | Takagi et al. | 340/568 |

FOREIGN PATENT DOCUMENTS

| | | |
|---|---|---|
| 821937 | 9/1968 | Canada . |
| 892386 | 10/1953 | Fed. Rep. of Germany . |
| 2912008 | 10/1980 | Fed. Rep. of Germany . |
| 3217888 | 11/1983 | Fed. Rep. of Germany . |
| 7634459 | 9/1978 | France . |

*Primary Examiner*—Glen R. Swann, III

*Attorney, Agent, or Firm*—Wood, Herron & Evans

[57] ABSTRACT

An alarm system that signals when one or more credit cards are absent from a card stack in the case if the system is enabled. In preferred form, a card stack thickness sensor responds to the stack thickness to determine whether all cards are present in the stack. A first signal device (e.g., a buzzer) in a circuit that includes a single sensor switch operated by the card stack thickness sensor informs the case's owner when not all cards are present if the circuit is enables. A second signal device (e.g., one or more of the cards, or a separate flag) that is projectable from and retractable into the case's interior is operated by a circuit enabling switch, this switch being manually controlled for enabling the circuit when the case is to be stored (the second signal device being disabled, i.e., the indicator being retracted into the case, when the circuit is enabled) and for disabling the circuit when one or more cards is intentionally removed from the case for use (the second signal device then being enabled, i.e., the indicator being projected from the case, when the circuit is disabled). The second signal device alerts the case's owner that the circuit has been disabled if that is the fact that the circuit has been disabled if that is the fact in the event the owner tries to inadvertently return the case to a pocket in the owner's clothing or to the owner's purse without first enabling the circuit by retracting the second signal device into the case's interior.

38 Claims, 8 Drawing Figures

CREDIT CARD CASE WITH ALARM SYSTEM

BACKGROUND OF THE INVENTION

1. Field of the Invention

This invention relates to credit cards. More particularly, this invention relates to an improved credit card case for carrying a series of credit cards.

2. Description of the Related Art

The use of credit cards has increased dramatically in the United States and around the world in recent years. It is often the case that an individual will have six or eight or more credit cards to carry, along with other personal effects, during the day's activities. Such credit cards may be bank credit cards, gasoline credit cards, merchant credit cards, travel credit cards, and the like. Of course, one problem with carrying multiple credit cards is that it is necessary to keep them assembled in a reasonable orderly fashion within the owner's pocket or purse. And toward this end, there have been created over the years a number of different credit card case structures which are adapted to store a series of credit cards until use of one or more is desired by the cards' owner. Such credit card cases are typically incorporated with wallets that are mainly directed to storage of paper money and coinage. But it is also well known to provide credit card cases which are primarily directed to storage of nothing but credit cards.

The use of credit cards has brought on a significant problem that periodically occurs to some card owners. When a credit card is to be used by the owner, the desired card is first withdrawn from its credit card case (or wallet or purse), and then is presented to the establishment, e.g., a retail store or hotel or the like, for use by the establishment's clerk in charging the owner's purchase. In other words, the credit card is temporarily taken from the owner's possession and presented to the establishment's clerk for use by the establishment in a purchase transaction. Of course, once the establishment's clerk is done making an imprint of the credit card on the charge slip in accord with the card owner's instruction, the clerk then returns the credit card to the card owner so the owner can return the card to its rightful place in the owner's credit card case or wallet or purse. But this last step periodically never occurs due to the forgetfulness of the clerk and/or the card owner. In other words, every once in a while a credit card owner will simply fail to retrieve his credit card from an establishment's clerk and, therefor, will fail to replace it in his credit card case or wallet or purse. When this happenstance occurs, i.e., when the card owner simply forgets to retrieve his card and return it to its rightful place of storage, then the credit card passes out of the owner's control for that time where it remains out of the owner's possession. And indeed, it may never return to the card owner's possession in that it simply thereafter could become lost or stolen. Of course, no credit card owner is desirous of losing a credit card because of unauthorized charge problems on the owner's credit card account that might arise while it is out of the owner's possession.

Now it is known to the prior art to provide a credit card case with an alarm system so that the case's owner is notified or signaled when an attempt is made to return the case to its storage position within the owner's pocket or purse without all cards being present. There are two basic types of such systems, one being a mechanical interference system and the other being an electric circuit system. The mechanical interference system is shown in U.S. Pat. Nos. 3,369,585 and 3,648,832. Both these patents disclose credit card carriers which make use of mechanical interference means in the event all cards are not replaced before the case flaps are folded together so that, in effect, the case cannot be closed in the first place due to that mechanical interference if all credit cards are not replaced within the case. The electrical circuit system approach is shown in U.S. Pat. Nos. 3,959,789 and 4,480,250. Each of those prior art patents discloses a credit card carrier with a series of electric switches provided for the cards, and an overall circuit control switch operated either through use of a timer, or through opening and closing of the case flaps. But each of these circuit system approaches makes use of a separate pocket for each individual credit card, and each makes use of a separate credit card sensor switch associated with each of those pockets. So from a commercial embodiment standpoint that might be saleable at retail, it seems to applicant that both the mechanical interference and electric circuit prior art approaches, as disclosed in the above-mentioned patents, may have a couple of disadvantages. But all of the disadvantages revolve around the fact that those prior art credit card carriers have relatively complex type alarm systems that are relatively expensive to manufacture and that are relatively bulky in final unit size. Therefor such prior art systems may not be desired by the retail consumer who is the ultimate arbiter of a new product's success.

SUMMARY OF THE INVENTION

Accordingly, it has been one objective of this invention to provide an improved credit card case adapted to store a stack of credit cards which cooperates with an alarm system that incorporates only a single credit card sensor for sensing the presence of all cards in the card stack, and the absence of one or more cards in the card stack, in combination with a single sensor switch operated by that credit card sensor, thereby eliminating multiple mechanical and/or electric card sensors and/or switches.

It has been another objective of this invention to provide an improved credit card case adapted to receive a series of credit cards in stored relation, same having an alarm system that incorporates a manually controlled enabling switch that enables/disables a first signal device connected with a card sensor, and that enables a second signal device by extending that second signal device beyond the case's housing to show that the first signal device is disabled, and that disables that second signal device by retracting it into the case's housing to show that the first signal device is enabled, whether all cards are present in the case or not.

It has been a further objective of this invention to provide an improved credit card case adapted to receive a series of credit cards in stored relation, same having an electric alarm system with a single switch connected to a card sensor, and connected to a first signal device that signals when one or more cards is removed from stored relation, that single switch permitting the case's owner to disable the first signal device when desired, and that same single switch also being a part of the card sensor switch so that a signal is provided to the case's owner when one or more cards is removed from stored relation after the first signal device is enabled, the case thereby requiring only a single switch for two or more cards stored within the case.

It has been another objective of this invention to provide an improved credit card case adapted to receive a series of credit cards in stored relation, same having an access delivery device that extends one or more credit cards from a storage position within the case's interior to an access position beyond the case's housing, and that retracts the previously extended card back into the storage position from the access position, and same having an electric alarm system that is disabled in response to extension of that access delivery device to the card access position and enabled in response to return of that access delivery device to the card storage position.

It has been still a further objective of this invention to provide an improved credit card case adapted to receive a series of credit cards in stored relation, same having an alarm system with an enabling switch that enables a first signal device connected with a card sensor when the switch is enabled whether the case is opened or closed, and that enables a second signal device and disables the first signal device when the enabling switch is disabled whether the case is opened or closed, the second signal device being adapted to alert the case's owner if the owner attempts to reinsert the closed case into the owner's pocket or purse without the enabling switch being enabled.

In accord with these objectives, the credit card case of this invention has a housing adapted to receive a series of credit cards in stacked relation one against the other. The case includes an alarm system that, functions to signal the case's owner when one or more cards are absent from the case if the system is enabled, a credit card sensor that responds to the thickness of the credit card stack determining whether all cards are present in the stack, or whether one or more cards is absent from the stack. In preferred form, the alarm system includes a first signal device in the form of an aural indicator (e.g., a buzzer) in a circuit that includes a single sensor switch operated by the card stack thickness sensor for informing the case's owner when not all cards are present if the circuit is enabled. The alarm system also includes a second signal device in the form of a visual indicator (e.g., one or more of the cards, or a separate flag) that is projectable from and retractable into a case's interior as operated by a circuit enabling switch, this switch being manually controlled for enabling the circuit when the case is to be stored (the second signal device being disabled, i.e., the indicator being retracted into the case, when the circuit is enabled) and for disabling the circuit when one or more cards is intentionally removed from the case for use (the second signal device being enabled, i.e., the indicator being projected from the case, when the circuit is disabled). The second signal device alerts the case's owner that the circuit has been disabled if that is the fact in the event the owner tries to inadvertently return the case to a pocket in the owner's clothing or to the owner's purse without first enabling the circuit by retracting the second signal device into the case's interior.

DESCRIPTION OF THE DRAWINGS

Other objectives and advantages of this invention will be more apparent from the following detailed description taken in conjunction with the drawings in which.

DESCRIPTION OF THE PREFERRED EMBODIMENTS

Figure 1:
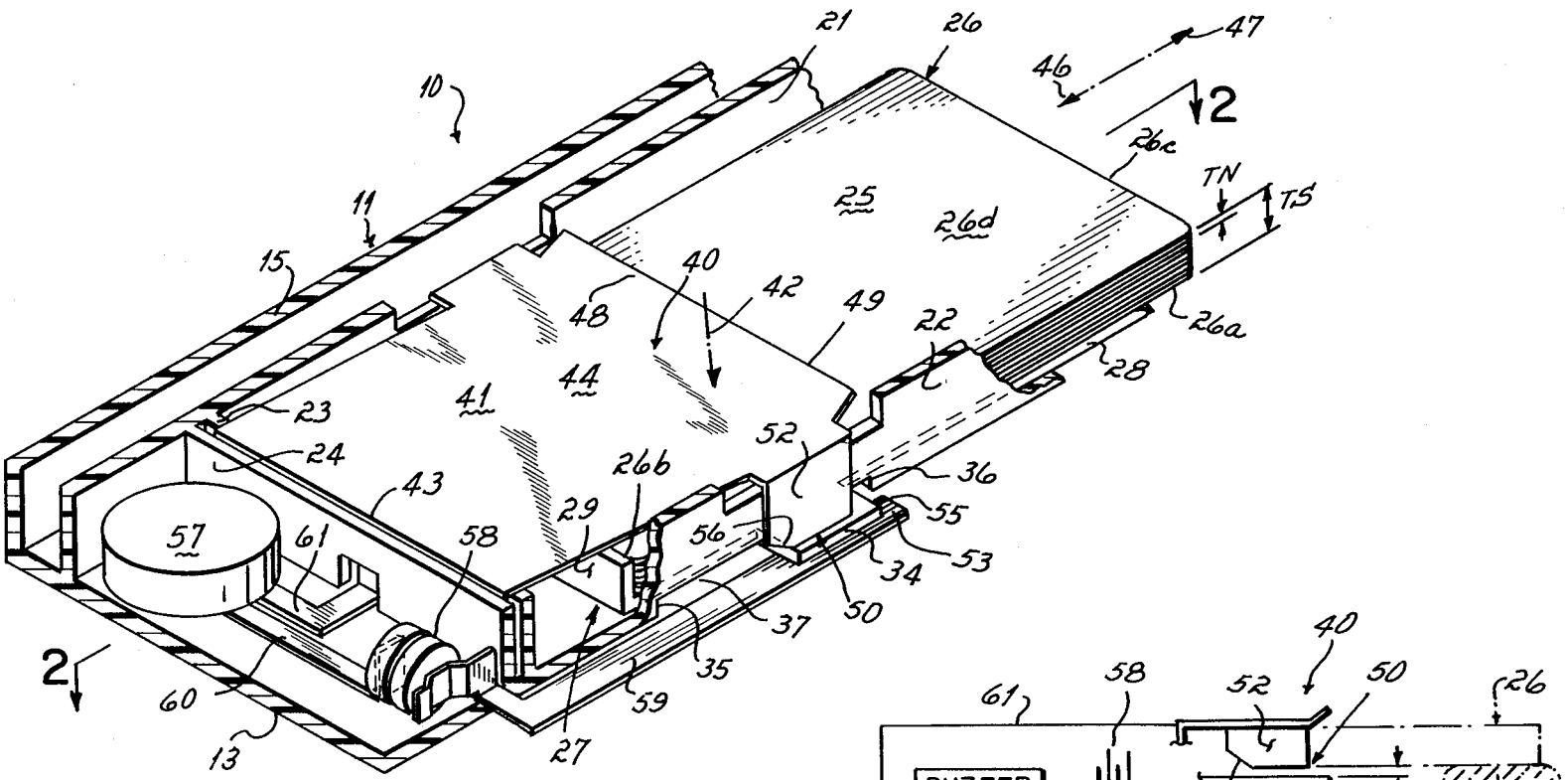
FIG. 1 is a partially broken away isometric view illustrating a first embodiment of a credit card case in accord with the principles of this invention.

A first embodiment of a credit card case 10 in accord with the principles of the invention is particularly illustrated in FIGS. 1–4. The credit card case includes a main housing 11 and a flip to cover 12. The housing 11 and cover 12 combined, in the closed position, provide opposed front 13 and rear 14 walls of significant breadth and width, opposed side walls 15, 16, a floor wall 17, and a top wall 18. The cover 12 is pivotably connected to the housing on hinge pin 19, and mates with the housing's top edge as defined by the front 13, rear 14, and side walls 15, 16. When the cover 12 is pivoted open it exposes the interior of the housing 11, and opening and/or closing of the lid has no functional effect on the credit card case other than simply to open or close the case's interior to its environment.

The case's housing 11 also includes certain interior wall structure. This interior wall structure includes interior guide walls 21, 22 adjacent to and parallel to respective side walls 15, 16 which not only provide added rigidity to the case's external configuration, but also function as guides as explained in further detail below. The interior guide walls extend along the length of the case's housing from the top wall 18 end to the floor wall 17 end thereof. The interior wall structure also includes spaced foot walls 23, 24 that extend across the breadth of the case's housing 11 adjacent to the housing's floor wall 17 end.

A series of six credit cards 25 are received in stacked relation one upon the other, i.e., individual pockets for each credit card are not used, interiorly of the housing 11. This credit card stack 26 is positioned within a carriage 27 slideably disposed within the housing 11 between guide walls 21, 22 of the housing. The credit card carriage 27 has a face wall 28 and a foot wall 29, side face **26*a* of the card stack laying against the carriage's face wall and end edge 26*b* of the card stack abutting the carriage's foot wall. The carriage 27 includes a slide button 30 mounted on face wall 28 that extends out through slot 31 in the housings' front wall 13. Since the carriage's 30 button extends through the slot 31 in the housing's front wall 13, the case's owner can easily move or slide that button between opposed ends 32, 33 of the slot so as to move the carriage 27 between a card access position shown in FIG. 1 and a card storage position shown in FIG. 2 vis-a-vis the housing. Note particularly in the card access position shown in FIG. 1 that the top end 26c of the credit card stack has been entirely projected above, i.e., extended out of, the case's housing 11 so that all cards 25 are readily accessible to the case's owner. Of course, when the cards 25 are so projected out of the housing by use of the carriage's slide button 30, the case's cover 12 is pivoted open to permit that egress of the cards. Thus, the carriage 27 acts as an access delivery device that extends the card stack 26 from a storage position within the case's interior to an access position beyond the case's housing 11**.

The credit card carriage 27 also includes an enabling switch in the form of tab 34 fixed to and extending outwardly beyond a side edge of the carriage's face wall 28. This switch tab 34 moves between opposed ends 35, 36 of slot 37 in the housing's interior guide wall 22 as manually operated by the carriage's slide button 30. When the switch tab 34 abuts upper end 36 of that slot 37 the card stack 26 is in the extended or card access position shown in FIG. 1. So the upper end 36 of the tab slot 37 acts as an upstop for the carriage 27. When the switch tab 34 abuts the bottom end 35 of the interior wall slot 37, the carriage 27 and, hence, the credit card stack 26, are retracted into a storage position within the housing 11. The bottom end 35 of that slot 37 thereby acts as a down stop for the carriage 27.

The credit card case 10 incorporates an alarm system that includes a credit card sensor 40 which determines the presence of all cards 25 within the case, and which also determines the absence of one or more cards from the case. This credit card sensor 40 is in the form of a leaf spring 41 which bears against rear face 26d of the credit card stack. The leaf spring 41 is continuously spring loaded against the card stack 26 with a spring force represented by phantom arrow 42. The leaf spring 41 is a generally L-shaped leaf spring having its foot end 43 positioned and held between interior foot walls 23, 24 of the housing 11 and, as mentioned, the leaf end 44 of the leaf spring bears against the exposed face 26d of the card stack 26. Note the leaf spring's axis 45 is generally parallel to the ingress 46/egress 47 path of the credit cards 25 with the case 10 when the case's cover 12 is open. Note also the leaf spring's free top edge is provided with a lip 48 that flares outwardly to present an open mouth 49 between the leaf spring 41 and the credit card stack 26 in order to easily direct previously removed credit cards 25 back into the confined area of the case in reassembly with the carriage 27.

Figure 4:
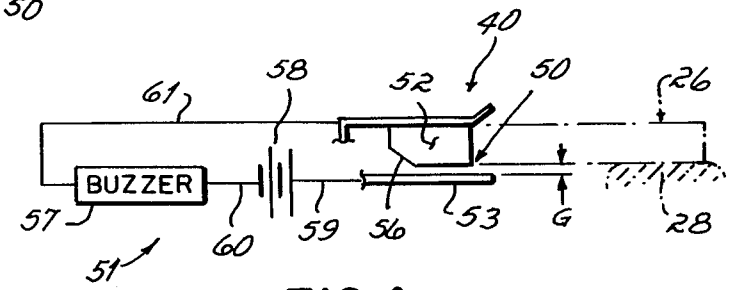
FIG. 4 is a schematic view illustrating an alarm circuit incorporated in the credit card case shown in FIGS. 1–3.
Figure 2:
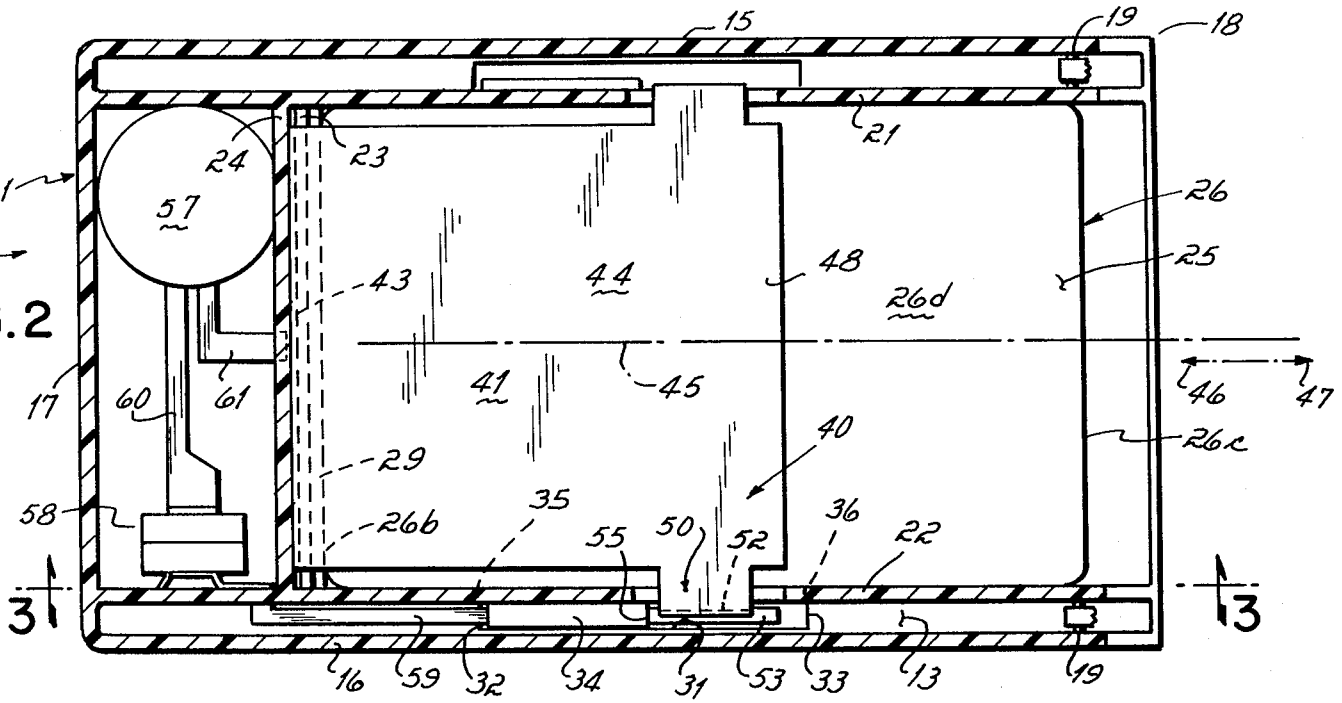
FIG. 2 is a cross sectional view taken along line 2—2 of FIG. 1 except that the enabling switch has been disabled.
Figure 3:
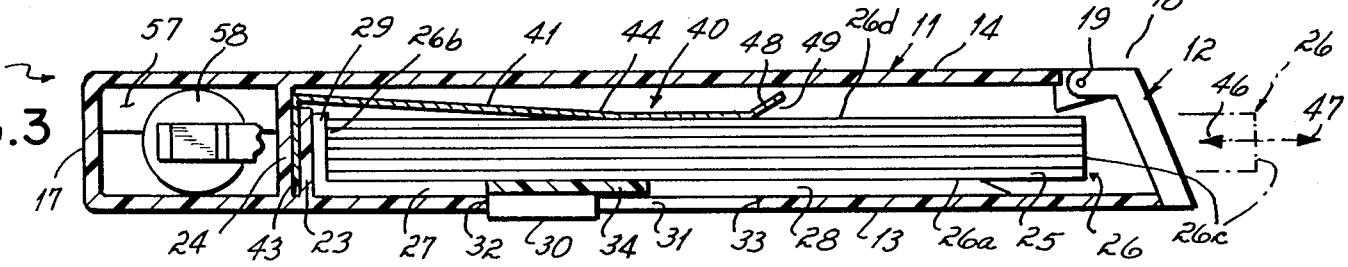
FIG. 3 is a cross sectional view taken along line 3—3 of FIG. 2 except that one credit card has been removed from the card stack.

The card sensor 40 also includes a sensor switch 50 that is part of the case's electrical circuit 51 shown in FIG. 4. The sensor switch 50 includes a movable contact 52 that is fixed to the free or top end of the leaf spring 41. The sensor switch 50 also includes an immobile contact 53 fixed to the interior face of the housing's front wall 13 to cooperate with the movable contact 52 carried by the leaf spring 41. There is a definite spatial relationship between the thickness TS of the card stack and the gap G established between the sensor switch's leaf spring contact 52 and immobile contact 53 when all cards (six as shown in the embodiment illustrated) are present within the case 10. This gap G distance between the sensor switch's movable contact 52 and immovable contact 53 is less than the thickness TN of any one of the credit cards 25. With this spatial relationship, and because the leaf spring 41 continuously is biased in a direction normal to the plane of the credit cards 25 as shown by phantom arrow 42, when any one of the credit cards is removed from the card stack 26, i.e., when any one of the credit cards is removed from the case 10, the spring loading causes the sensor switch's movable contact 52 to engage the fixed contact 53 if the circuit is enabled as shown in FIG. 2.

The alarm system also includes a manually operated enabling switch in the form of switch tab 34 which enables/disables the electric circuit 51. This tab switch, as previously mentioned, is mounted on the cards' carriage 27. The switch tab 34 is movable into a circuit 51 disabling attitude shown in FIG. 1 when the carriage 27 is moved to extend the credit cards beyond the case's housing 11 in the card access position as shown in FIG. 1. In so moving the switch tab 34 to the circuit 51 disabling attitude shown in FIG. 1, the leading edge 55 of the switch tab slides against cam edge 56 of the sensor switch's movable contact 52 so as to upraise that sensor switch's movable contact off the sensor switch's fixed contact 53, thereby disabling the circuit 51 at that point. Conversely, and as the carriage 27 is retracted into the housing 11 so the credit cards 25 are stored therein, the switch tab 34 is moved out from operative relation with the sensor switch's movable contact 52 so that electric contact is made once again between the sensor switch's movable and fixed 53 contacts. Accordingly, and simultaneously with extending the credit card stack 26 outward into an access position beyond the case's housing 11, the sensor switch 50 is also automatically disabled. And conversely, upon retracting the credit card stack 26 into the housing's interior by use of the carriage's slide button 30, the sensor switch is automatically enabled. So the circuit's first or aural signal device (in the form of buzzer 57) will be activated only if the card carriage 27 is retracted into the case's housing 11 so that the buzzer cannot be inadvertently activated when the cards 25 are extended into the card access position for use by the case's owner.

The alarm system also includes a second or visual signal device that is connected with, and operated by, the enabling switch (which includes the switch tab 34 and the slide button 30). This second signal device, in this first embodiment, is comprised of the credit cards 25 themselves. The credit cards 25, i.e., the second signal device, are retracted within the housing 11 when the enabling switch 30, 34 is in the circuit 51 enabling position shown in FIG. 2, and are projected from the housing out through its open top when the enabling switch is in the circuit disabling position shown in FIG. 1. Of course the second signal device functions to notify the case's owner when the alarm circuit 51 is disabled (because the top 26c end of the card stack 26 is visually exposed to the case owner's view, thereby enabling the second signal device), and also functions to signal the case's owner when the circuit is enabled (because the card stack is retracted interiorly of the case's housing away from the owner's view, thereby disabling the second signal device.

The alarm system's electric circuit 51 is particularly shown in FIG. 4, and the leaf spring 41 itself is an integral part of that circuit. The electric circuit 51 includes the sensor switch 50 with immobile contact 53 connected to two 1.2 volt button batteries 58 by metal strip lead 59. The circuit 51 also includes a first buzzer strip lead 60 connected between the batteries 58 and the buzzer, and a second buzzer strip lead 61 connected between the buzzer and the metal leaf spring 41. The electric circuit 51 also includes the enabling switch in the form of switch tab 34 and slide button 30.

Use of the credit card case 10 of this invention, in the normally stowed position, is as shown in FIG. 2. The alarm system's enabling switch 30, 34 is enabled with the switch tab 34 being out of mechanical interference with the sensor switch 50 as so moved by the carriage's slide button 30 because of the carriage 27 position as manually moved by the owner. And in this normally stowed position, note particularly a gap G is established between the sensor switch's movable contact 52 and immobile contact 53 because all six cards 25 are present within the case. Accordingly, and even though the circuit 51 is enabled in the FIG. 1 normally stowed position, the buzzer 57 gives no aural signal because the circuit is broken at the card's sensor switch 50 for the simple reason all cards are stowed within the housing 11. And the visual signal that might be provided by virtue of the carriage 27 having extended the card stack 26 out beyond the case's housing (as shown in FIG. 1) to inform the case's owner that the circuit 51 is not enabled, on the other hand, is not presented because the card stack 26 is retracted into the housing 11 since indeed the circuit is enabled. This operational attitude and function of the case remains in effect whether the case's cover 12 is opened or closed. When the card carrier case 10 is initially removed from or replaced in the owner's pocket or purse, as well as when it is stowed within the owner's pocket or purse, and under normal circumstance, it will be in this FIG. 2 attitude.

When it is desired to take a card 25 out of the case for use at an establishment, the first step simply is to pivot the case's cover 12 open. Thereafter, the entire stack 26 of cards 25 is extended outwardly beyond the case's housing 11 by moving carriage 27 in a direction shown by phantom arrow 47 through use of slide button 30. And as the carriage 27 is so moved as to extend the top end **26*c* of the card stack 26 beyond the case's housing 11, the enabling switch's switch tab 34 mechanically interferes, i.e., is disposed between, the mobile 52 and immobile contacts 53 of, the card sensor switch 50. So as long as the carriage 27 is in the card exposure position shown in FIG. 1, whether one or more cards 25 is removed therefrom is of no matter because the spring 41 loaded movable contact 52 of the sensor switch 50 is prevented from contact with that switch's fixed contact 53. This, of course, causes the alarm system circuit 51 to become fully disabled while the credit cards 25 and carriage 27 are in the extended or card access position. This is important because it would not be desirable to have the buzzer 57 sound with the carriage 27 in that position where the cards 25 project partially beyond the case's housing 11 because it is not desirable to have the buzzer sound with the case 10 removed from the owner's pocket and while a removed credit card is being used by an establishment's clerk. So to cancel the buzzer 57 signal during the time a card 25 is being used by the establishment's clerk, this is automatically achieved when the carriage 27 extends the cards 25 into the card access position in that the circuit 51 is disabled because the enabling switch 30, 34 mechanically functions to disable the circuit by providing interference with the sensor switch 50**.

Now the second signal device, in the form of the top end **26*c* of the credit card stack 26 itself, visually informs the case's owner that the circuit 51 is disabled whether or not one of the credit cards 25 has been removed for use by an establishment's clerk. Of course if a card 25 has been so removed, and if the case's owner inadvertently retracts the remaining cards, i.e., inadvertently retracts the case's carriage 27, back into the storage position within the case 10, then that manual function by the case's owner will automatically enable the case's sensor switch 50. The sensor switch 50 will be automatically enabled because the mirror movement of the enabling switch's tab 34 from the up stop 36 position to the down stop 35 position removes the mechanical interference otherwise provided by that tab between the sensor switch's movable contact 52 and fixed contact 53. And so if a credit card 25 has been inadvertently not returned to the card stack before the carriage 27 is retracted into storage position within the case's housing 11, then indeed the buzzer 57 will sound as soon as the spring loaded sensor switch's movable contact 52 once again engages that switch's fixed contact 53 because the electric circuit 51 is completed. If such a happenstance occurred, this would remind the owner that one of the cards 25 had not been replaced in the case and that the non-replaced card should be retrieved. So in effect the extension or retraction of the credit card carriage 27 (and, hence, the credit card stack 26) relative to the case's housing 11 functions to disable and enable the alarm system circuit 51 automatically in response to manual movement of that carriage. And the extension and retraction of the credit card stack 26 relative to the case's housing 11 also provides a visual signal to the case's owner as to whether the circuit 51 is enabled or disabled depending on whether the cards 25** are extended into view or retracted from view.

Figure 5:
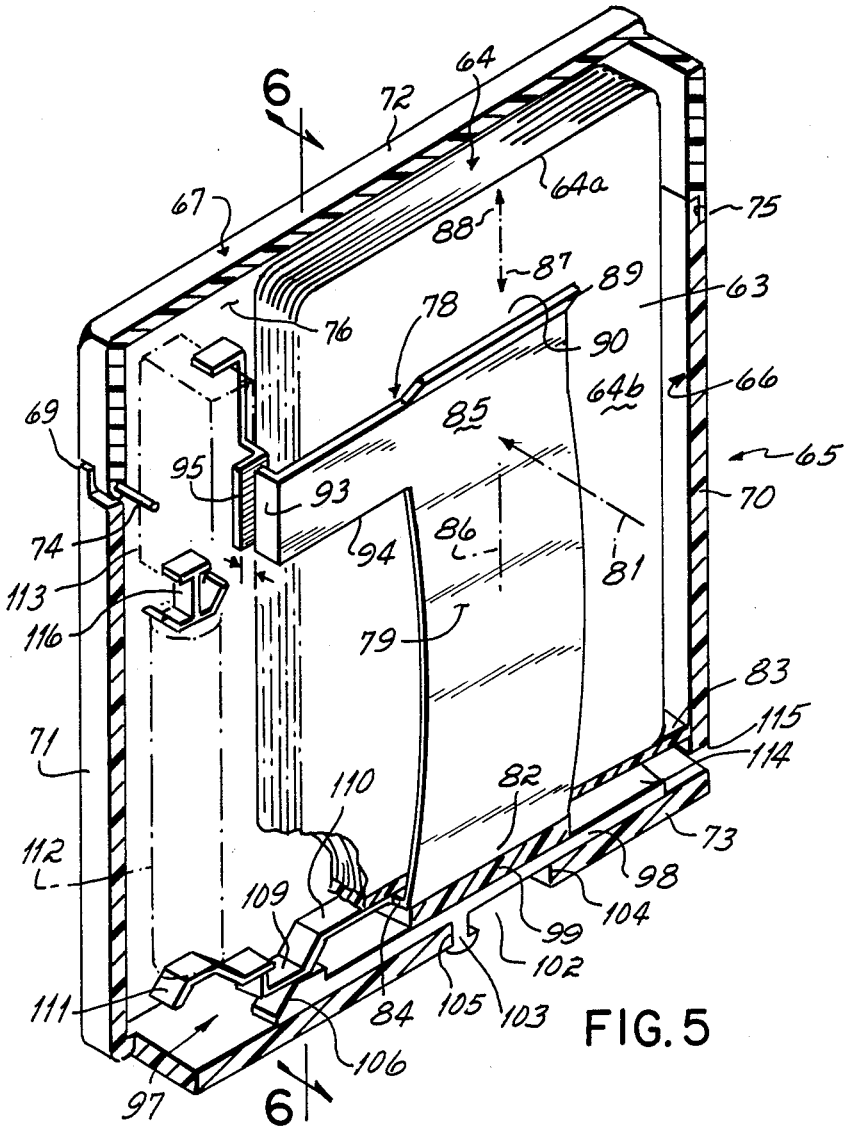
FIG. 5 is a partially broken away isometric view illustrating a second embodiment of a credit case in accord with the principles of this invention.
Figure 6:
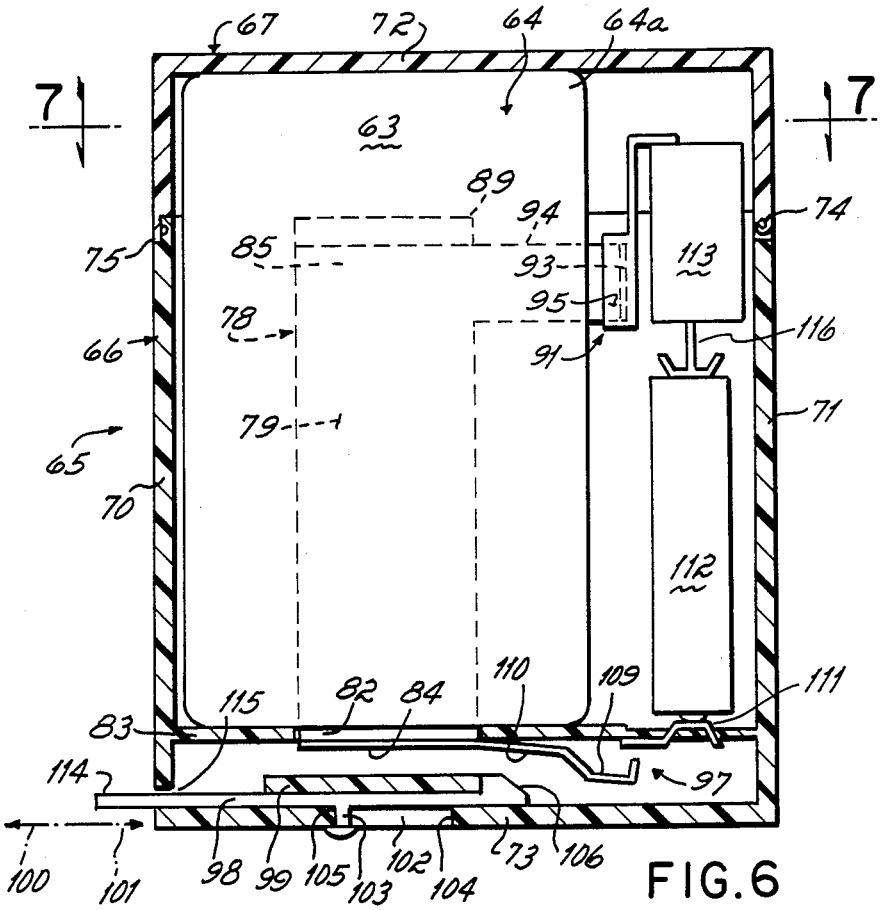
FIG. 6 is a cross sectional view taken along line 6—6 of FIG. 5 except that the enabling switch has been disabled.
Figure 7:
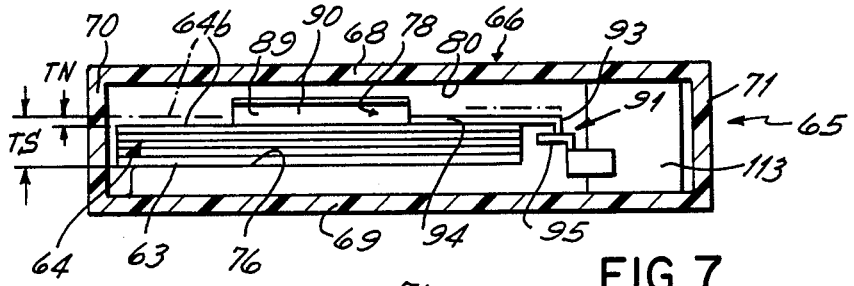
FIG. 7 is a cross sectional view taken along line 7—7 of FIG. 6 except that one credit card has been removed from the stack.

A second embodiment of a credit card case 65 in accord with the principles of this invention is particularly illustrated in FIGS. 5–8. The credit card case 65 includes a main housing 66 and a cover 67. The housing 66 and cover 67 combined, in the closed position, provide opposed side faces 68, 69 of significant breadth and width, a front wall 70, a rear wall 71, a top wall 72 and a floor wall 73. The cover 67 is pivotably connected to the housing 66 on hinge pin 74, and mates with the housing's top edge at lip 75. When the cover 67 is pivoted open it exposes the top end 64a of a stack 64 of credit cards 63 (six are shown for illustrative purposes) held in the housing 66. Note particularly, as shown in FIGS. 5 and 7, that all of the credit cards 63 are stacked one upon the other, i.e., individual pockets for each credit card are not used. The credit card stack 64 is positioned within the housing 66 against the inner face 76 of one side wall 69.

The credit card case 65 incorporates an alarm system that includes a credit card sensor 78 which determines the presence of all cards 63 within the case, and which also determines the absence of one or more cards within the case. This credit card sensor 78 is in the form of a leaf spring 79 interposed between exterior surface **64*b* of the card stack 64 and interior face 80 of side wall 68, the leaf spring continuously bearing against the card stack with a spring force represented by phantom arrow 81. The leaf spring 79 is fixed at one end 82 to immobile sub-floor wall 83 by virtue of the leaf spring's leg 84 being fixed to that sub-floor. The other end 85 of the leaf spring 79 bears against the interiorly disposed face 64*b* of the card stack 64. Note the leaf spring's axis 86 is generally parallel to the ingress 87/egress 88 path of the credit cards 63 with the case 65 when the case's cover 67 is opened. Note also the leaf spring's top edge is provided with a flared lip 89 that flares outwardly to present an open mouth 90 between the leaf spring and the case's side wall 80 opposite thereto in order to easily direct the credit cards 63 into the confined area of the case 65 which is the final storage position as shown in FIG. 1**.

Figure 8:
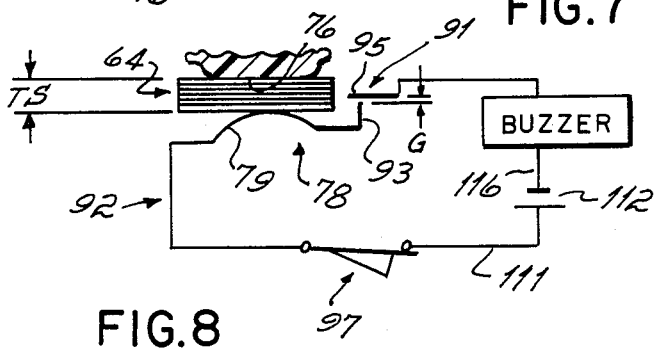
FIG. 8 is a schematic view illustrating an alarm circuit incorporated in the credit card case shown in FIGS. 5–7.

The card sensor 78 also includes a sensor switch 91 that is part of the case's electrical circuit 92 shown in FIG. 8. The sensor switch 91 includes a movable contact 93 fixed to the free end of arm 94 that extends from the top end 85 of leaf spring 79. The sensor switch 91 also includes an immobile switch contact 95 fixed to the housing 66 that cooperates with the movable switch contact 93 carried by the leaf spring 79. There is a definite spatial relationship between the thickness TS of the card stack 64 and the gap G established between the sensor switch's leaf spring contact 93 and immobile contact 95 when all cards (six as shown in the embodiment illustrated) are present within the case 65. This gap G distance between the sensor switch's movable contact 93 and immovable contact 95 is less than the thickness TN of any one of the credit cards 63. With this spatial relationship, and because the leaf spring 79 continuously is biased in a direction normal to the plane of the credit cards as shown by phantom arrow 81, when any one of the credit cards 63 is removed from the card stack 64, i.e., when any one of the credit cards is removed from the case 65, the leaf spring 79 loading causes the sensor switch's movable contact 93 to engage the fixed contact 95. Accordingly, the alarm system's electric circuit 92 is enabled by that sensor switch 91 when any one card 63 is removed from the case 65.

The alarm system also includes a manually operated switch 97 which enables/disables the electric circuit 92. This enabling switch 97 is in the form of a slide bar 98 captured between the case's bottom wall 73 and bracket 99. The slide bar 98 is movable in a reversible direction shown by phantom arrow 100, 101 a distance established by the length of slot 102 in the case's floor 73. A finger pin 103 fixed to the slide bar 98 extends through the slot 102 for manual use by the case's owner. Accordingly, the slide bar 98 can be manually moved between a circuit enabling position shown in solid lines in FIG. 5 where the pin 103 abuts edge 104 of the slot 102, and a circuit disabling position shown in solid lines in FIG. 6 where the pin abuts edge 105 of that slot. The enabling switch 97 also includes a cam head 106 at inner end of the slide bar 98, the cam head being adapted to cooperate with foot 109 attached to the spring leg 110 of the leaf spring 79. The leaf spring's foot 109 is normally spring biased away from electric contact with battery contact 111, as shown in FIG. 6, when the slide bar 98 (and, hence, the cam head 106) is in the circuit disabling position. But the leaf spring's spring leg 110 and, hence, the contact foot 109, is biased or cammed up into electric contact with battery contact 111 when the slide bar 98 is moved into the solid line position shown in FIG. 1 where the slide bar's cam head 106 forces or cams the spring leg's foot 109 against contact 111 against which the battery 112 is seated. And in the solid line FIG. 1 position for the enabling switch 97, the circuit 92 is enabled so that if all cards 63 are not present in the case 65 as sensed by the card sensor 78 then the circuit's first signal device (in the form of buzzer 113) will be activated. And the buzzer 113 will be activated, assuming the circuit 92 is enabled, whether the case's cover 67 is opened or closed.

The alarm system also includes a second signal device (in the form of flag 114) that is connected with, and operated by, slide bar 98. The flag 114 is retracted within the housing 66 when the enabling switch 97 is in the circuit enabling position shown in FIG. 5, and is projected from the housing out through flag port 115 when the enabling switch is in the circuit disabling position shown in FIG. 6. The second signal device or flag 114, therefor, is operable whether the housing's cover 67 is opened or closed, too, just as is the case with the first signal device or buzzer 113.

The alarm system's electric circuit 92 is particularly shown in FIG. 8, and the leaf spring 79 itself is part of that circuit. The electric circuit 92 includes the sensor switch 91 with immobile contact 95 connected to the buzzer 113 and movable contact 93 connected to the spring 79. The circuit 92 also includes enabling switch 97 with movable contact 109 connected to the spring 79 and fixed contact 111 connected to the battery 112. The battery 112 and buzzer 113 are connected by lead 116. A useful buzzer 113 is that sold as catalog No. 273-053 by the Radio Shack Division, Tandy Corp. A useful storage battery is 1.5 volt triple A battery. So the leads in the alarm circuit shown in FIG. 8 are mainly comprised of the leaf spring 79, the leaf spring's arm 94 and the leaf spring's leg 110, and by spacer 116, as shown in FIG. 5.

Use of the credit card case of this invention, in the normally stowed position, is as shown in FIG. 5. The alarm system's enabling switch 97 is enabled with the switch's movable contact 109 being in electrical contact with the battery contact 111 because of the position of slide bar 98 as moved manually by the owner's hand through use of finger pin 103. And in this normally stowed position, note particularly a gap G is established between the sensor switch's movable contact 93 and immobile contact 95 because all six cards 63 are present within the case 65. Accordingly, and even though the circuit 92 is enabled in the FIG. 5 normally stowed position, the buzzer 113 gives no aural signal because the circuit 92 is broken at the card's sensor switch 91 for the simple reason all cards are stowed within the housing. And the visual signal that might be provided by flag 114 to inform the case's owner that the circuit 92 is not enabled, on the other hand, is not presented because the flag is retracted into the housing 66 since indeed the circuit is enabled. This operational attitude and function of the case 65 remains in effect whether the cover 67 is opened or closed. When the card carrier case 65 is initially removed from or replaced in the owner's pocket or purse, as well as when it is stowed within the owner's pocket or purse, and under normal circumstances, it will be in the FIG. 5 attitude.

When it is desired to take a card 63 out of the case for use at an establishment, the first step simply is to pivot the case's cover 67 open. Thereafter, one or more of the six credit cards 63 is removed by the case's owner. And as soon as one of the cards 63 is removed, the sensor switch's contacts 93, 95 complete the electric circuit 92 so that buzzer 113 sounds. But it is not desirable to have the buzzer 113 sound with the case 65 removed from the owner's pocket, and while a credit card 63 is being used by an establishment's clerk. So to cancel the buzzer 113 signal during the time the credit card 63 is being used by the establishment's clerk, the case's owner simply slides slide bar 98 to the FIG. 6 position until finger button 103 abuts edge 105 of the slot 102 in the case's floor 73. This disables the circuit 92 because the enabling switch 97 is then in the circuit disabling position so the buzzer 113 no longer sounds. And this prevents the buzzer 113 from sounding even though the sensor switch 91 remains enabled.

As shown in FIG. 6, note particularly that the flag 114 carried by slide bar 98, when the slide bar is slid into the alarm circuit disabling position shown, extends outward through port 115 in front wall 70 of the credit card case 65 into a very visible signal position. Now it is possible that, with a credit card 63 removed, the case's owner might inadvertently try to return the case to the owner's pocket or purse. But the fact that the signal flag 114 extends through port 115 provides a visual signal to the owner that the case should not be returned without checking to make sure all cards 63 are present because the owner recalls that visibility of the flag indicates the alarm circuit 92 is disabled and, therefor, the buzzer 113 would not sound even if one or more cards is missing from the case 65. And if the visual flag 114 signal is missed by the case's owner, the flag will mechanically interfere with the owner's pocket or purse interior so as to provide a touch or feel type of signal to the card's owner that the circuit 92 has been disabled as the owner tries to stow the case 65 with the flag extended. In either event, i.e., whether the owner responds to the visual signal or the touch or feel signal, and because the slide bar's flag 114 extends out beyond the case's exterior surface, the owner would be alerted to checking the case to make sure all credit cards 63 are present.

If the owner found all cards 63 were present, then the owner would return the enabling switch 97 to the circuit enabling position shown in FIG. 5, thereby withdrawing the flag 114 into the case's interior. And because all cards 63 were present within the case 65, the sensor switch 91 would disable the circuit 92 because gap G would be established between that switch's two contacts 93, 95 so that buzzer 113 would not sound. On the other hand, and upon enabling the circuit 92 by moving the enabling switch 97 to the flag withdrawn position, if all six cards 63 were not present within the case 65, i.e., if one or more cards was still out of the case, then an aural signal would be received from the buzzer 113 because the sensor switch 91 is enabled, i.e., because gap G is eliminated, thereby alerting the case's owner to the fact all cards 63 are not present. And being so alerted, the case's owner would retrieve that one or more cards 63 not present in the case, then insert it into the case, thereby disabling the sensor switch 91 so that the buzzer 113 would not sound even with the enabling switch 97 enabled. This would make the case 65 ready once again for storage in the owner's pocket or wallet or purse.

Having described in detail the preferred embodiment of my invention, what I desire to claim and protect by Letters Patent is:

1. A credit card case comprising a housing adapted to receive a series of credit cards in stacked relation interiorly thereof in a storage position, a card sensor that responds to the thickness of said credit card stack for determining whether all cards are present in said stack or whether one or more cards are absent from said stack, and a first signal device connected with said card sensor, said first signal device being adapted to signal the case's owner when one or more cards are absent from said case.

2. A credit card case as set forth in claim 1, said case comprising a second signal device extendable beyond said housing to indicate visually that said first signal device is disabled, and that is retractable into said housing to indicate visually that said first signal device is enabled, and an enabling switch that enables and disables both said first and second signal device whether or not all cards are present in said case.

3. A credit card case as set forth in claim 1, said case comprising a single switch connected to said card sensor and connected to said first signal device, that single switch being operable by the case's owner to enable and to disable said first signal device when desired, and that same single switch also being operable in response to the presence or absence of one or more cards so that a signal is provided to the case's owner if one or more cards is removed from stored relation after said first signal device is enabled.

4. A credit card case as set forth in claim 1, said case comprising a second signal device adapted to alert the case's owner if the owner attempts to store the closed case without said first signal device being enabled, and an enabling switch that enables said first signal device when said switch is enabled whether said case is open or closed, and that enables said second signal device and disables said first signal device when switch is disabled whether said case is opened or closed.

5. A credit card case as set forth in claim 1, said case comprising a battery operated electric circuit, said first signal device being electrically connected with alarm circuit.

6. A credit card case as set forth in claim 5, said card sensor comprising a metal sensor spring adapted to continuously bear against said card stack, said sensor spring also constituting a part of said circuit.

7. A credit card case as set forth in claim 6, said card sensor comprising a sensor switch having a movable contact formed from the same metal stamping as said sensor spring.

8. A credit card case as set forth in claim 1, said case comprising a cover connected with said housing for opening and closing said housing's interior to the environment, said first signal device being operable whether said housing's cover is opened or closed.

9. A credit card case as set forth in claim 8, said case comprising a second signal device that informs the case's owner whether said first device is disabled whether or not all cards are present in said stack, said second signal device also being operable whether said housing's cover is open or closed.

10. A credit card case as set forth in claim 4, said enabling switch comprising a slide button manually operable by the case's owner and said second signal device comprising a visual indicator operable to extend beyond said housing's exterior surface into, and to retract into said housing's interior away from view of the casual observer when said slide button is manually operated.

11. A credit card case as set forth in claim 10, said visual indicator comprising one of a flag and a credit card.

12. A credit card case as set forth in claim 11, said case comprising a carriage slideable between extension and retraction positions within said case's housing, at least one of said credit cards being supported on said carriage, and said visual indicator comprising an end of that carriage supported credit card when said carriage is moved into its extension position.

13. A credit card case as set forth in claim 12, said carriage comprising an enabling switch tab mounted on said carriage as part of said enabling switch, said enabling switch tab being operable to prevent contact of said sensor's switch's two contacts when said carriage is in the extended position.

14. A credit card case as set forth in claim 11, said flag being extended beyond said case's exterior surface when said enabling switch is disabled and being moved interiorly of said case's housing when said enabling switch is enabled.

15. A credit card case comprising a housing adapted to receive a series of credit cards in stored relation, a first signal device adapted to signal the case's owner when one or more cards are absent from said case, a second signal device extendable beyond said housing to indicate visually that said first signal device is disabled, and that is retractable into said housing to indicate visually that said first signal device is enabled, and an enabling switch that enables and disables both said first and second signal device whether or not all cards are present in said case.

16. A credit card case as set forth in claim 15, said housing being adapted to receive a series of credit cards in stacked relation interiorly thereof in a storage position, said case comprising a card sensor that responds to the thickness of said credit card stack for determining whether all cards are present in said stack or whether one or more cards are absent from said stack.

17. A credit card case as set forth in claim 15, said case comprising a card sensor for determining whether all cards are present in said case, or whether one or more cards are absent from said case, and a single switch connected to said card sensor and connected to said first signal device, that single switch being operable by the case's owner to enable and to disable said first signal device when desired, and that same single switch also being operable in response to the presence or absence of one or more cards so that a signal is provided to the case's owner if one or more cards is removed from stored relation after said first signal device is enabled.

18. A credit card case as set forth in claim 15, said case comprising an access delivery device adapted to extend one or more of said credit cards from a stored position in said housing into an access position at least partially beyond said housing, and that retracts the previously extended card back into said stored position from said access position, said first signal device alarm system being disabled in response to extension of said credit card to said card access position, and being enabled in response to return of said credit card to said card storage position.

19. A credit card case as set forth in claim 15, said case comprising a battery operated electric circuit, said first signal device being electrically connected with alarm circuit, and a metal sensor spring adapted to continuously bear against said card stack, said sensor spring also constituting a part of said circuit.

20. A credit card case as set forth in claim 19, said card sensor comprising a sensor switch having a movable contact formed from the same metal stamping as said sensor spring, and a movable contact also formed from the same metal stamping as said sensor spring.

21. A credit card case as set forth in claim 15, said first signal device being in the form of an aural indicator, and said second signal device being in the form of a visual indicator.

22. A credit card case as set forth in claim 15, said second signal device comprising one of a flag and a credit card.

23. A credit card case as set forth in claim 22, said case comprising a carriage slideable between extension and retraction positions within said case's housing, at least one of said credit cards being supported on said carriage, and said second signal device comprising an end of that carriage supported credit card when said carriage is moved into its extension position.

24. A credit card case as set forth in claim 23, said carriage comprising an enabling switch tab mounted on said carriage as part of said enabling switch, said enabling switch tab being operable to prevent contact of said sensor's switch's two contacts when said carriage is in the extended position.

25. A credit card case comprising a housing adapted to receive a series of credit cards in stored relation, a first signal device adapted to signal the case's owner when one or more cards are absent from said case, a card sensor for determining whether all cards are present in said case, or whether one or more cards are absent from said case, and a single switch connected to said card sensor and connected to said first signal device, that single switch being operable by the case's owner to enable and to disable said first signal device when desired, and that same single switch also being operable in response to the presence or absence of one or more cards so that a signal is provided to the case's owner if one or more cards is removed from stored relation after said first signal device is enabled.

26. A credit card case as set forth in claim 25, said case comprising a second signal device extendable beyond said housing to indicate visually that said first signal device is disabled, and that is retractable into said housing to indicate visually that said first signal device is enabled.

27. A credit card case as set forth in claim 25, said case comprising an access delivery device adapted to extend one or more of said credit cards from a stored position in said housing into an access position at least partially beyond said housing, and that retracts the previously extended card back into said stored position from said access position, said first signal device being disabled in response to extension of said credit card to said card access position, and being enabled in response to return of said credit card to said card storage position.

28. A credit card case as set forth in claim 25, said case comprising a battery operated electric circuit, said first signal device being electrically connected with alarm circuit, and said card sensor comprising a metal sensor spring adapted to continuously bear against said card stack, said sensor spring also constituting a part of said circuit.

29. A credit card case as set forth in claim 28, said card sensor comprising a movable contact formed from the same metal stamping as said sensor spring, said movable contact being a part of said single switch.

30. A credit card case as se forth in claim 26, said case comprising a carriage slideable between extension and retraction positions within said case's housing, at least one of said credit cards being supported on said carriage, and said second signal device comprising an end of that carriage supported credit card when said carriage is moved into its extension position.

31. A credit card case as set forth in claim 25, said case comprising structure within said housing's interior adapted to receive said credit cards in stacked relation, and said card sensor that responds to the thickness of said credit card stack for determining whether all cards are present in said stack, or whether one or more cards are absent from said stack.

32. A credit card case comprising a housing adapted to receive a series of credit cards in stored relation, an access delivery device adapted to extend one or more of said credit cards from a stored position in said housing into an access position at least partially beyond said housing, and that retracts the previously extended card back into said stored position from said access position, and an alarm system connected to said access delivery device, said alarm system being disabled in response to extension of said credit card to said card access position, and being enabled in response to return of said credit card to said card storage position.

33. A credit card case as set forth in claim 32, said housing being adapted to receive a series of credit cards in stacked relation interiorly thereof in a storage position, said case comprising a card sensor that responds to the thickness of said credit card stack for determining whether all cards are present in said stack or whether one or more cards are absent from said stack, and a first signal device connected with said card sensor, said first signal device being adapted to signal the case's owner when or more cards are absent from said case.

34. A credit card case as set forth in claim 32, said alarm system comprising a first signal device adapted to signal the case's owner when one or more cards are absent from said case, a second signal device extendable beyond said housing to indicate visually that said first signal device is disabled, and that is retractable into said housing to indicate visually that said first signal device is enabled, and an enabling switch that enables and disables both said first and second signal device whether or not all cards are present in said case.

35. A credit card case as set forth in claim 32, said alarm system comprising a first signal device adapted to signal the case's owner when one or more cards are absent from said case, a card sensor for determining whether all cards are present in said case, or whether one or more cards are absent from said case, and a single switch connected to said card sensor and connected to said first signal device, that single switch being operable by the case's owner to enable and to disable said first signal device when desired, and that same single switch also being operable in response to the presence or absence of one or more cards so that a signal is provided to the case's owner if one or more cards is removed from stored relation after said first signal device is enabled.

36. A credit card case as set forth in claim 32, said alarm system comprising a first signal device adapted to signal the case's owner when one or more cards are absent from said case, a second signal device adapted to alert the case's owner if the owner attempts to store the closed case without said first signal device being enabled, and an enabling switch that enables said first signal device when said switch is enabled whether said case is open or closed, and that enables said second signal device and disables said first singal device when switch is disabled whether said case is opened or closed.

37. A credit card case as set forth in claim 33, said case comprising a battery operated electric circuit, said first signal device being electrically connected with alarm circuit, and a metal sensor spring adapted to continuously bear against said card stack, said sensor spring also constituting a part of said card sensor and a part of said circuit.

38. A credit card case comprising a housing adapted to receive a series of credit cards in stored relation, a first signal device adapted to signal the case's owner when one or more cards are absent from said case, a second signal device adapted to alert the case's owner if the owner attempts to store the closed case without said first signal device being enabled, and an enabling switch that enables said first signal device when said switch is enabled whether said case is open or closed, and that enables said second signal device and disables said first signal device when switch is disabled whether said case is opened or closed.

* * * * *